US008590907B2

(12) United States Patent
Hurt et al.

(10) Patent No.: US 8,590,907 B2
(45) Date of Patent: Nov. 26, 2013

(54) GARDENING STOOL

(75) Inventors: Dan Hurt, Clear Lake, MN (US); Sherry M. Rovig, Duluth, MN (US)

(73) Assignee: White Pine Concepts LLC, Palisade, MN (US)

( * ) Notice: Subject to any disclaimer, the term of this patent is extended or adjusted under 35 U.S.C. 154(b) by 535 days.

(21) Appl. No.: 12/761,181

(22) Filed: Apr. 15, 2010

(65) Prior Publication Data

US 2011/0254240 A1 Oct. 20, 2011

(51) Int. Cl.
*B62M 1/00* (2010.01)

(52) U.S. Cl.
USPC ..... 280/87.021; 280/87.01; 280/47.131; 280/47.25; 301/5.1

(58) Field of Classification Search
USPC ..... 280/87.042, 87.01, 87.021, 47.131, 280/47.25; 301/5.1, 5.301; 446/95, 465; 16/18 R, 45
See application file for complete search history.

(56) References Cited

U.S. PATENT DOCUMENTS

| | | | | |
|---|---|---|---|---|
| 2,369,934 | A * | 2/1945 | Aupperle | 280/244 |
| 3,180,678 | A * | 4/1965 | McCabe | 297/5 |
| 3,345,675 | A | 10/1967 | Haydock et al. | |
| 3,377,027 | A | 4/1968 | Mattson et al. | |
| 3,817,555 | A | 6/1974 | Kennedy | |
| 4,145,064 | A | 3/1979 | Carn | |
| 4,362,311 | A | 12/1982 | Bergman | |
| D296,048 | S | 6/1988 | Eie | |
| D321,796 | S | 11/1991 | Forrand | |
| 5,195,781 | A * | 3/1993 | Osawa | 280/842 |
| 5,727,843 | A | 3/1998 | LaTrace | |
| 6,578,859 | B2 * | 6/2003 | Chen | 280/87.01 |
| 6,834,916 | B2 | 12/2004 | Volkman et al. | |
| 2001/0040358 | A1 | 11/2001 | Ellis et al. | |

FOREIGN PATENT DOCUMENTS

| | | |
|---|---|---|
| FR | 2570262 | 3/1986 |
| GB | 1541000 | 5/1976 |
| KR | 10-2008-0102816 | 11/2008 |
| KR | 10-2009-0099883 | 9/2009 |

OTHER PUBLICATIONS

International Search Report and Written Opinion mailed Dec. 16, 2011.

* cited by examiner

*Primary Examiner* — Hau Phan
*Assistant Examiner* — Bryan Evans
(74) *Attorney, Agent, or Firm* — Merchant & Gould P.C.

(57) ABSTRACT

A stool includes a body having a seat and a wheel assembly. The seat is selectively rotatable about an axis of the stool. The wheel assembly is engaged to the seat. The wheel assembly includes a plurality of wheels. Each of the wheels includes an exterior surface having a first portion and a second portion. The second portion includes a contoured surface. The body is adapted to tilt onto the second portions of the wheels.

30 Claims, 13 Drawing Sheets

GARDENING STOOL

BACKGROUND

Gardeners often sit on a chair or a stool to perform gardening-type work for long periods of time. While chairs or stools provide some comfort to the gardener, the gardener must still lean over to reach vegetation that is very close to the ground. Such activities can cause aches and pains over prolonged time periods.

SUMMARY

An aspect of the present disclosure relates to a stool having a body including a seat and a wheel assembly. The seat is selectively rotatable about an axis of the stool. The wheel assembly is engaged to the seat. The wheel assembly includes a plurality of wheels. Each of the wheels includes an exterior surface having a first portion and a second portion. The second portion includes a contoured surface. The body is adapted to tilt onto the second portions of the wheels.

Another aspect of the present disclosure relates to a stool having a body including a seat, a sleeve and a wheel assembly. The seat includes a first surface and an oppositely disposed second surface. The seat includes a seat post that extends from the second surface. The sleeve defines a bore that receives the seat post. The seat is selectively rotatable about a vertical axis of the sleeve. The wheel assembly is engaged to the sleeve. The height of the seat is adjustable relative to the wheel assembly. The wheel assembly includes a frame having a first axle and a second axle. A first plurality of wheels is engaged to the first axle. A second plurality of wheels is engaged to the second axle. Each of the wheels includes an exterior surface having a first portion and a second portion. The first portion is generally cylindrical while the second portion includes a contoured surface. The body is adapted to tilt onto the second portions of the wheels.

Another aspect of the disclosure relates to a method of using a stool. The method includes propelling a stool in a first direction. The seat of the stool is rotated so that a front portion of the seat is generally perpendicular to the first direction. The stool is tilted onto contoured portions of exterior surfaces of the wheels of the stool. The stool is tilted in a direction that is generally perpendicular to the first direction.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
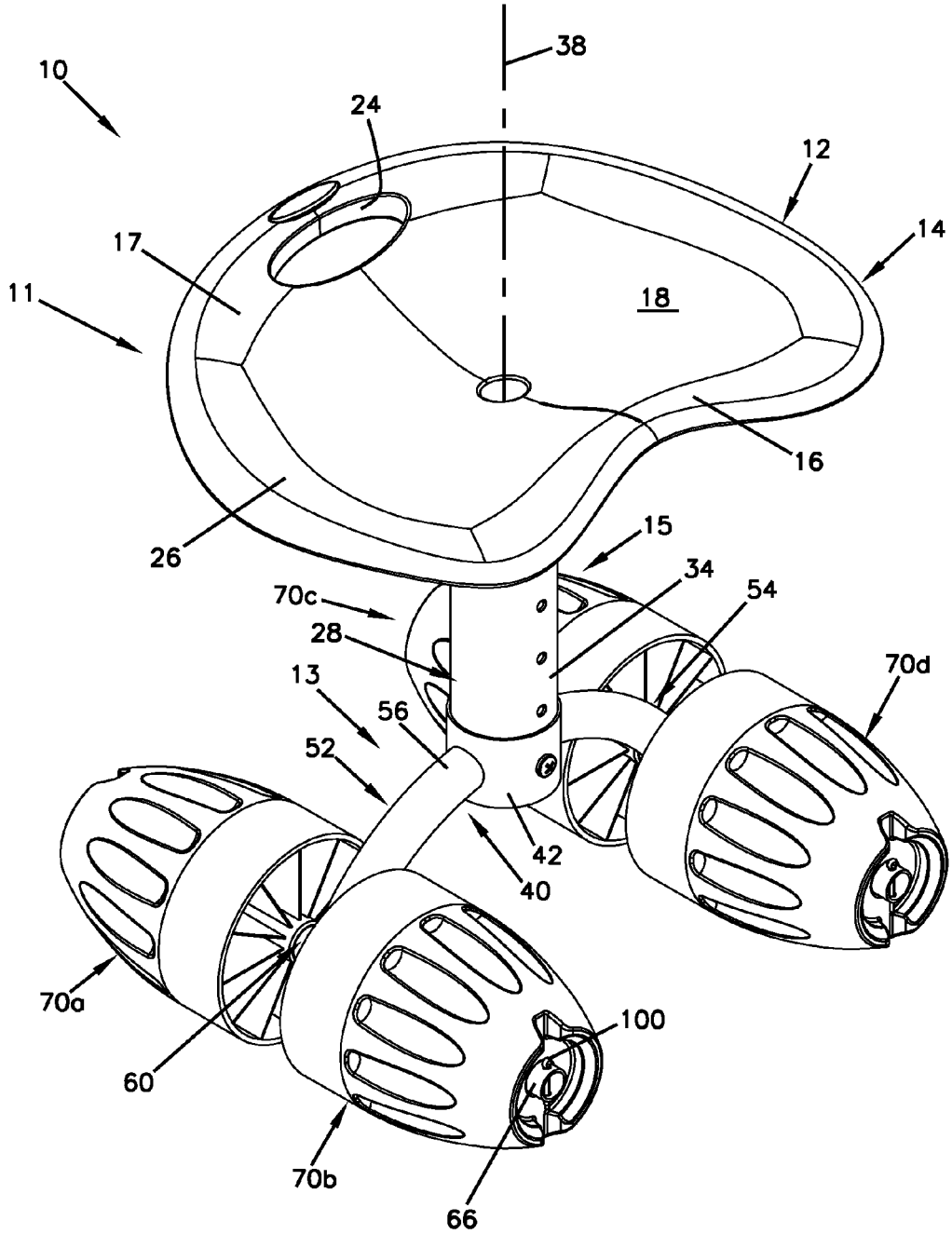
FIG. 1 is a perspective view of a stool having exemplary features of aspects in accordance with the principles of the present disclosure.
Figure 2:
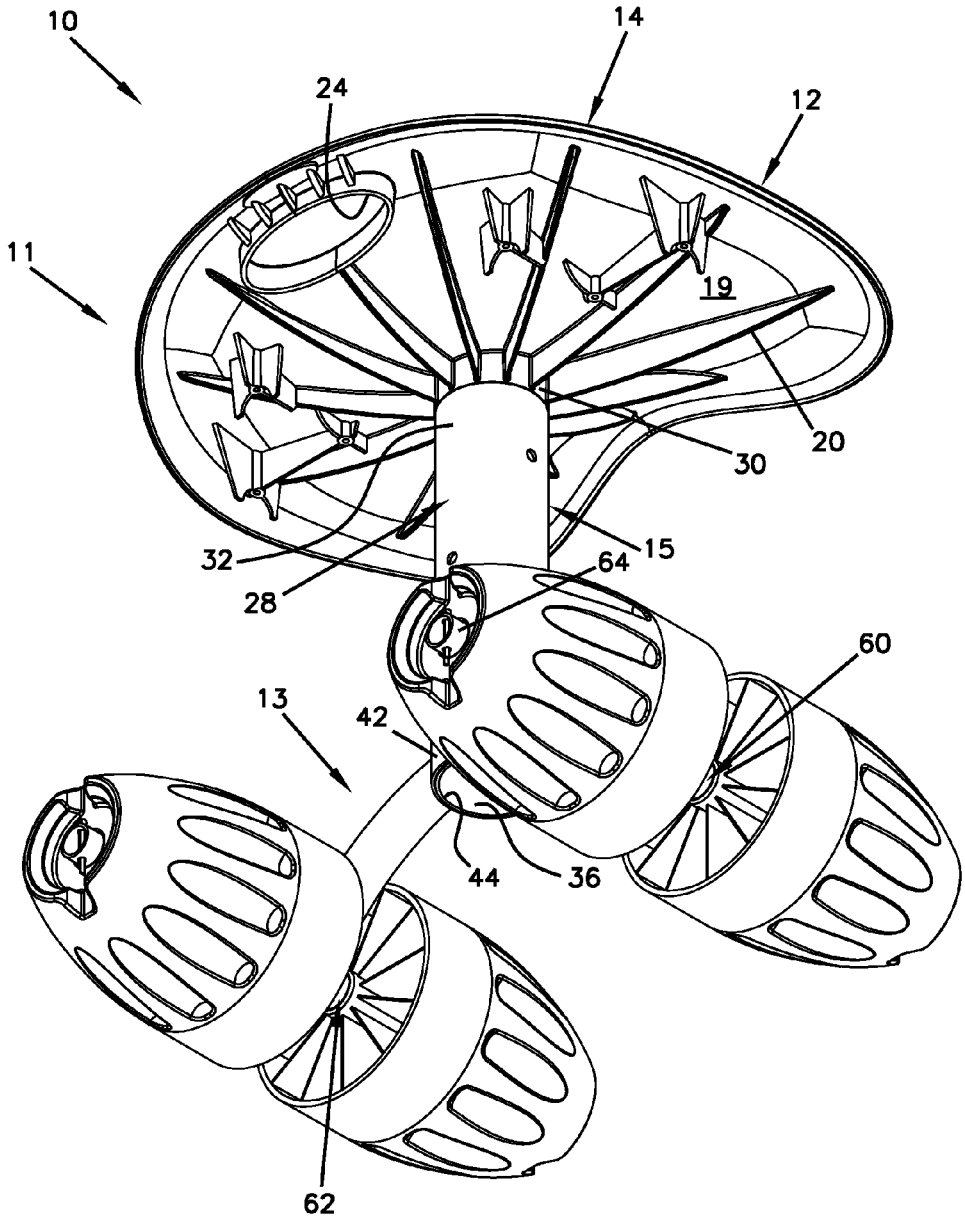
FIG. 2 is another perspective view of the stool of FIG. 1.

Referring now to FIGS. 1 and 2, a stool 10 is shown. The stool 10 is adapted to be used for gardening. The stool 10 includes a body 11 having a seat assembly 12 and a wheel assembly 13 connectedly engaged to the seat assembly 12.

The seat assembly 12 includes a seat 14 and a support structure such as a seat post assembly 15. The seat 14 includes a front portion 16 and a back portion 17. In the depicted embodiment, legs of a user extend outwardly from the front portion 16 of the seat 14 when the user is sitting in the seat 14.

The seat further includes a first surface 18 and an oppositely disposed second surface 19. In the depicted embodiment, the first surface 18 is contoured so that the first surface 18 is generally concave in shape.

The second surface 19 includes a plurality of supports 20. The supports 20 radiate outwardly from the seat post assembly 15 of the seat 14. The supports 20 are adapted to increase the weight capacity of the seat 14.

The seat 14 further includes an opening 24. The opening 24 is disposed at a perimeter portion 26 of the seat 14. In the depicted embodiment, the opening 24 is disposed at the perimeter portion 26 of the back portion 17 of the seat 14. The opening 24 extends through the first and second surface 18, 19 of the seat 14. In one embodiment, the opening 24 serves as a handle for the stool 10 that can be grasped by a user.

The seat post assembly 15 extends outwardly from the second surface 19 of the seat 14. In the depicted embodiment, the seat post assembly 15 includes a sleeve 28 and a seat post 30.

The sleeve 28 includes a first axial end portion 32 and an oppositely disposed second axial end portion 34. The sleeve 28 is generally cylindrical in shape and defines a central longitudinal bore 36. In the depicted embodiment, the central longitudinal bore 36 extends through the first and second axial end portions 32, 34 of the sleeve 28.

The seat post 30 is generally cylindrical in shape. In the depicted embodiment, the seat post 30 and the seat 14 are integrally formed so that the seat post 30 and the seat 14 are a single piece. A portion of the seat post 30 is received in the central longitudinal bore 36 of the first axial end portion 32 of the sleeve 28 so that the seat 14 is disposed adjacent to the first axial end portion 32 of the sleeve 28. The seat post 30 is disposed in the bore 36 of the sleeve 28 so that the seat 14 can selectively rotate about an axis 38 of the stool 10 that extends through the center of the central longitudinal bore 36 of the sleeve 28. In the depicted embodiment, the axis 38 is a vertical axis. In one embodiment, the sleeve 28 and the seat post 30 form a plain bearing. In another embodiment, a bushing may be disposed between the sleeve 28 and the seat post 30.

In one embodiment, the seat 14 selectively rotates between a working position (shown in FIGS. 1 and 2) and a travel position. In the travel position, the seat 14 is rotated about 90 degrees from the working position about the axis 38.

In another embodiment, the seat 14 is adapted to selectively tilt relative to the seat post assembly 15. In this embodiment, the seat 14 is connected to the seat post 30 by a universal joint. The universal joint allows the seat 14 to tilt about a second axis that is generally perpendicular to the axis 38.

Referring now to FIGS. 1-6, the wheel assembly 13 is shown. The wheel assembly 13 includes a frame 40. The frame 40 includes a collar 42.

In the depicted embodiment, the collar 42 is centrally disposed on the frame 40. The collar 42 defines a bore 44 that is adapted to receive the second axial end portion 34 of the sleeve 28 of the seat post assembly 15. The collar 42 further defines a thru-hole 46 that extends through the collar 42 in a direction that is generally perpendicular to the bore 44. The thru-hole 46 is adapted to receive a fastener 48 (e.g., screw, bolt, pin, etc.) that secures the sleeve 28 of the seat post assembly 15 to the frame 40. The fastener 48 is received in a hole 50 of the second axial end portion 34 of the sleeve 28. In the depicted embodiment, the second axial end portion 34 of the sleeve 28 defines a plurality of holes 50 that are axially aligned. The plurality of holes 50 allow the height of the seat 14 relative to the wheel assembly 13 to be raised or lowered.

The frame 40 includes a first arm 52 and a second arm 54. The first and second arms 52, 54 extend outwardly from the collar 42 in a generally radial direction. The first and second arms 52, 54 are oppositely disposed about the collar 42. In the depicted embodiment, the first and second arms 52, 54 are disposed about the collar 42 so that the first and second arms 52, 54 are about 180 degrees apart.

Each of the first and second arms 52, 54 includes a first end 56 and a second end 58. The first end 56 of each of the first and second arms 52, 54 is engaged to the collar 42. The second end 58 of the first arm 52 is engaged to a first axle 60 while the second end 58 of the second arm 54 is engaged to a second axle 62. In the depicted embodiment, the first and second axles 60, 62 are generally perpendicular to the first and second arms 52, 54, respectively.

In the depicted embodiment, the first and second arms 52, 54 are configured so that the collar 42 of the wheel assembly 13 is disposed a vertical distance D from the first and second axles 60, 62 where the vertical distance D is greater than zero. As the vertical distance D between the collar 42 and the first and second axles 60, 62 increases, more holes 50 can be added to the sleeve or the distance between adjacent holes 50 can be increased, which increases the height adjustment capability of the seat 14. In the depicted embodiment, the first and second arms 52, 54 are configured in a generally arcuate shape.

In the depicted embodiment, the first and second axles 60, 62 are generally parallel. Each of the first and second axles 60, 62 includes a first end 64 and an oppositely disposed second end 66. In the depicted embodiment, the first and second ends 64, 66 of the first axle 60 are coaxial and the first and second ends 64, 66 of the second axle 62 are coaxial.

The wheel assembly 13 further includes a plurality of wheels 70 engaged to the frame 40. At least one wheel 70 is engaged to the first arm 52 of the frame 40 and at least one wheel 70 is engaged to the second arm 54. In the subject embodiment, a first wheel 70*a* is engaged to the first end 64 of the first axle 60 of frame 40, a second wheel 70*b* is engaged to the second end 66 of the first axle 60, a third wheel 70*c* is engaged to the first end 64 of the second axle 62 and a fourth wheel 70*d* is engaged to the second end 66 of the second axle 62. In the depicted embodiment, the first and second wheels 70*a*, 70*b* are coaxially aligned while the third and fourth wheels 70*c*, 70*d* are coaxially aligned. The wheels 70*a*, 70*b* have co-axial axes of rotation that extend through the axle 60 and the wheels 70*c*, 70*d* have co-axial axes of rotation that extend through the axle 62. The axes of rotation of the wheels 70*a*, 70*b* are retained/fixed in a parallel relationship relative to the axes of rotation of the wheels 70*c*, 70*d*.

Referring now to FIGS. 7-11, the wheel 70 is shown. The wheel 70 includes a body 72 having a central longitudinal axis 74. The body 72 of the wheel 70 includes a first side 76 (i.e., an inner side or end) and an oppositely disposed second side 78 (i.e., an outer side or end). The first and second sides 76, 78 are generally perpendicular to the central longitudinal axis 74. In the depicted embodiment, the first side 76 includes an outer diameter D1 that is greater than an outer diameter D2 of the second side 78. In one embodiment, the outer diameter D1 of the first side 76 is less than or equal to about 8 inches. In another embodiment, the outer diameter D1 of the first side 76 is less than or equal to about 6 inches. In another embodiment, the outer diameter D1 of the first side 76 is less than or equal to about 5 inches. In another embodiment, the outer diameter D1 of the first side 76 is less than or equal to about 4 inches.

The body 72 defines a thru-bore 80 that extends through the body 72 along the central longitudinal axis 74. The thru-bore 80 extends through the first and second sides 76, 78 and is adapted to receive one of the first and second ends of one of the first and second axles 60, 62 so that the wheel 70 can rotate relative to the axle.

The first side 76 includes a plurality of ribs 82 that radiate outwardly from the thru-bore 80. The plurality of ribs 82 is adapted to provide support to an exterior surface 84 of the wheel 70. In one embodiment, the ribs 82 extend axially from the first side 76 to the second side 78 of the body 72.

The second side 78 includes an end wall 84 and defines a recess 86. The recess 86 includes a recess wall 88 that is offset from the end wall 84. In the depicted embodiment, the recess wall 88 is generally parallel to the end wall 84.

The exterior surface 90 of the body 72 of the wheel 70 extends a total length L between the first side 76 and the second side 78. The total length L extends along and is measured along the central longitudinal axis 74. In the depicted embodiment, the total length L is greater than the outer diameter D1 of the first side 76.

The exterior surface 90 includes a first portion 92 and a second portion 94. The first portion 92 is disposed adjacent to the first side 76 of the body 72 while the second portion 94 is disposed adjacent to the second side 78. In the depicted embodiment, the second portion 94 is axially adjacent to the first portion 92.

In the depicted embodiment, the first portion 92 of the body 72 of the wheel 70 is generally cylindrical in shape. The first portion 92 of the body 72 of the wheel 70 is generally parallel to the central longitudinal axis 74. It will be understood that the terms "generally cylindrical" and "generally parallel" allow for a slight taper (i.e., less than or equal to about 4 degrees) for manufacturability purposes.

The second portion 94 extends from the first portion 92 to the second side 78 of the body 72. As the second portion 94 extends away from the first portion 92 toward the second side 78 of the body 72, the second portion 94 converges toward the central longitudinal axis 74 of the wheel 70. In other words, the second portion 94 tapers radially inwardly as the second portion 94 extends toward the second side 78.

Figure 9:
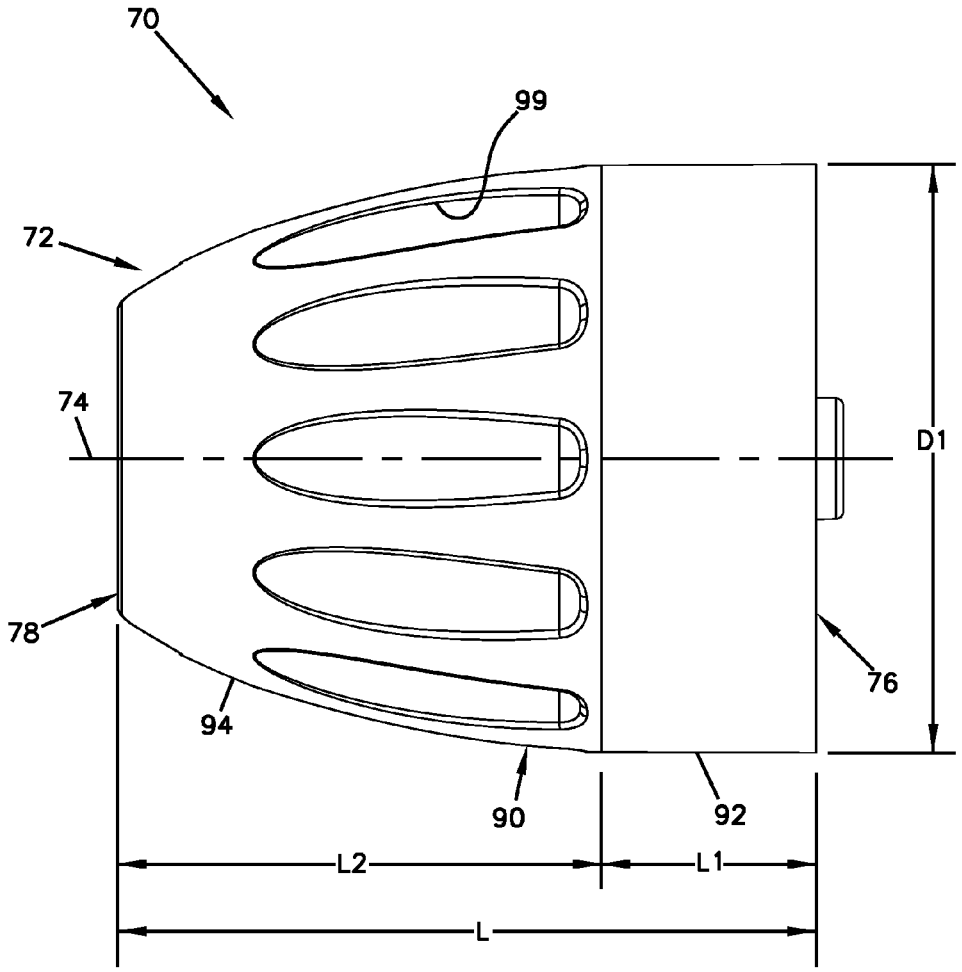
FIG. 9 is a front view of the wheel of FIG. 7.
Figure 10:
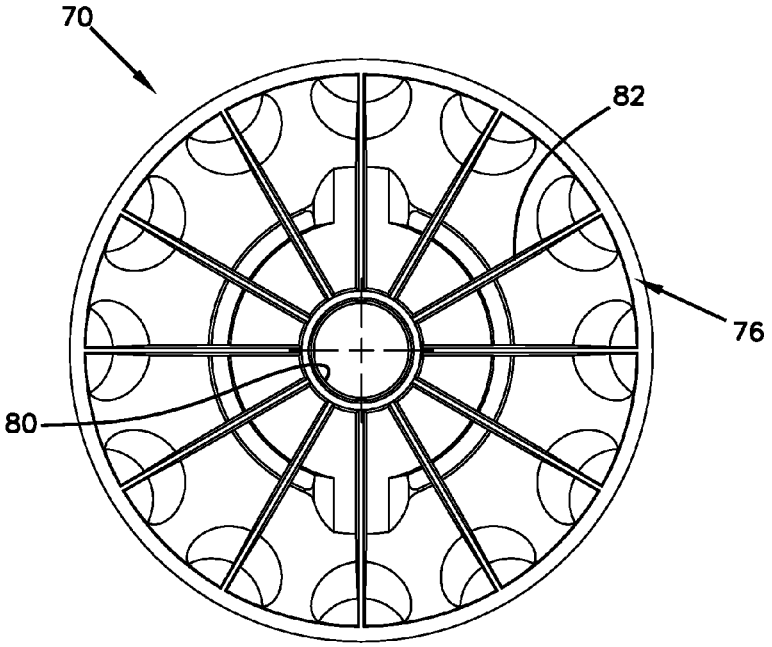
FIG. 10 is a left side view of the wheel of FIG. 7.
Figure 11:
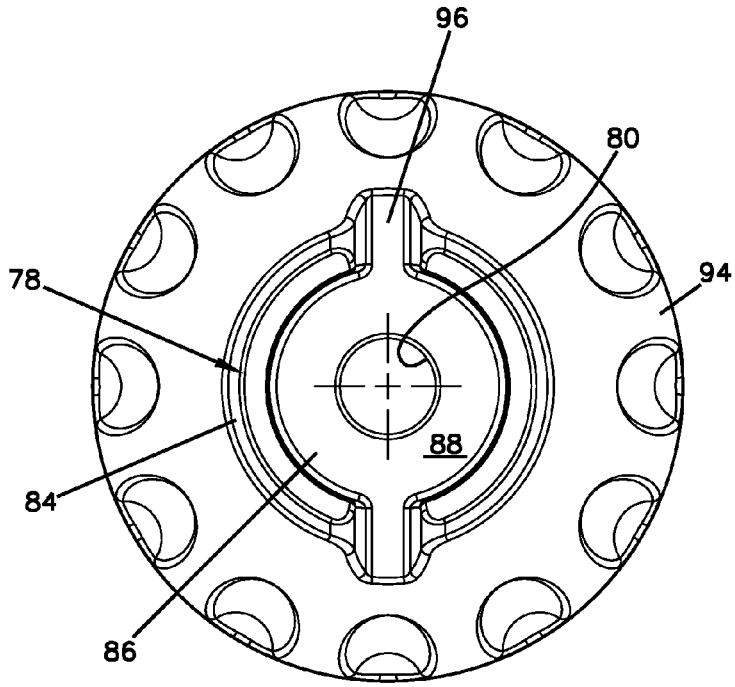
FIG. 11 is a right side view of the wheel of FIG. 7.

In the subject embodiment, the second portion 94 of the exterior surface 90 is a contoured portion. In the depicted embodiment, the second portion 94 has a truncated elliptical shape (i.e., frusto-elliptical). In another embodiment, the second portion 94 has a truncated conical shape (i.e., frusto-conical). As shown at FIG. 9, an angle θ defined by the second portion 94 gradually increases in magnitude as the second portion 94 extends towards the second side 78.

The first portion 92 extends a first length L1 along the central longitudinal axis 74 from the first side 76 of the body 72 in a direction toward the second side 78. The second portion 94 extends a second length L2 along the central longitudinal axis 74. In the depicted embodiment, the second length L2 is greater than the first length L1. In one embodiment, the first length L1 is less than or equal to about 75% of the second length L2

$$\left(\text{i.e., } \frac{L1}{L2} \leq 0.75 * L2\right).$$

In another embodiment, the first length L1 is less than or equal to about 50% of the second length. In another embodiment, the first length L1 is in a range of about 25% to about 75% of the second length L2. In one embodiment, the second length L2 is less than or equal to about 75% of the total length L of the exterior surface 90

$$\left(\text{i.e., } \frac{L2}{L} \leq 0.75 * L\right).$$

In another embodiment, the second length L2 is in the range of about 25% to about 75% of the total length L of the exterior surface 90. In another embodiment, the tapered length L2 is at least 20%, 30%, 40%, 50% or 60% as long as the total length L. In still other embodiments, the tapered length L2 is at least 2, 3 or 4 inches.

In the depicted embodiment, the second portion 94 of the exterior surface 90 defines a slot 96 disposed adjacent to the second side 78 of the body 72 of the wheel 70. The slot 96 extends through the exterior surface 90 to the recess 86 of the second side 78. The slot 96 includes an opening 98 disposed in the end wall 84 of the second side 78. In the depicted embodiment, the second portion 94 defines a plurality of slots 96 that are symmetrically disposed about the second portion 94.

The second portion 94 of the exterior surface 90 further includes a plurality of passages 99 that extend through the exterior surface 90. In the depicted embodiment, each of the passages 99 is elongated along the central longitudinal axis 74 of the wheel 70. The passages 99 are symmetrically disposed about the second portion 94 of the exterior surface 90. In one embodiment, there are twelve passages 99 disposed about the second portion 94.

Referring now to FIGS. 1, 2, 4 and 5, the plurality of wheels 70 is adapted for engagement with the first and second axles 60, 62 of the frame 40. To assembly one of the wheels 70 to the frame 40, one of the first and second ends 64, 66 ("one of the first and second ends 64, 66" will be referred to as "the end") of one of the first and second axles 60, 62 ("one of the first and second axles 60, 62" will be referred to as "the axle") is inserted into the thru-bore 80 at the first side 76 of the wheel 70. The end is inserted until the end extends outwardly from the recess wall 88 of the second side 78. With the end extending outwardly from the recess wall 88, the wheel 70 is secured to the axle by a fastener 100. In the depicted embodiment, the fastener 100 is a cotter pin that extends through a hole in the end of the axle. In one embodiment, a washer is disposed between the cotter pin and the wheel 70.

Figure 3:
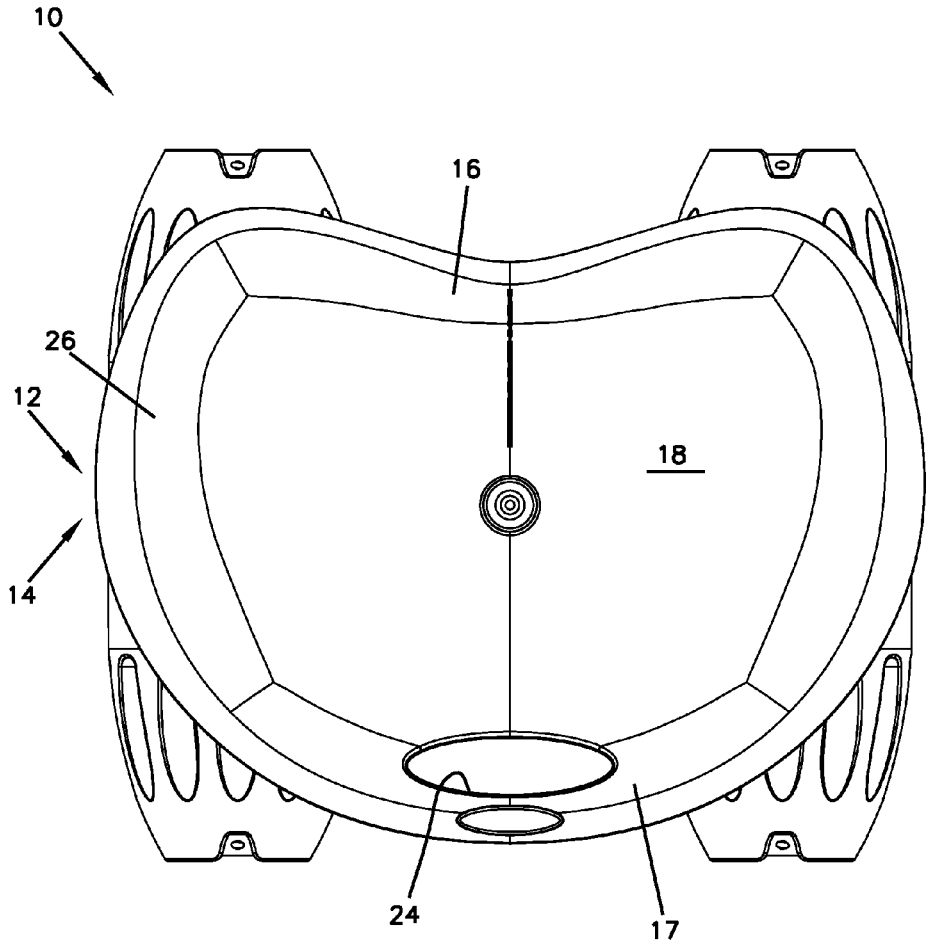
FIG. 3 is a top view of the stool of FIG. 1.
Figure 4:
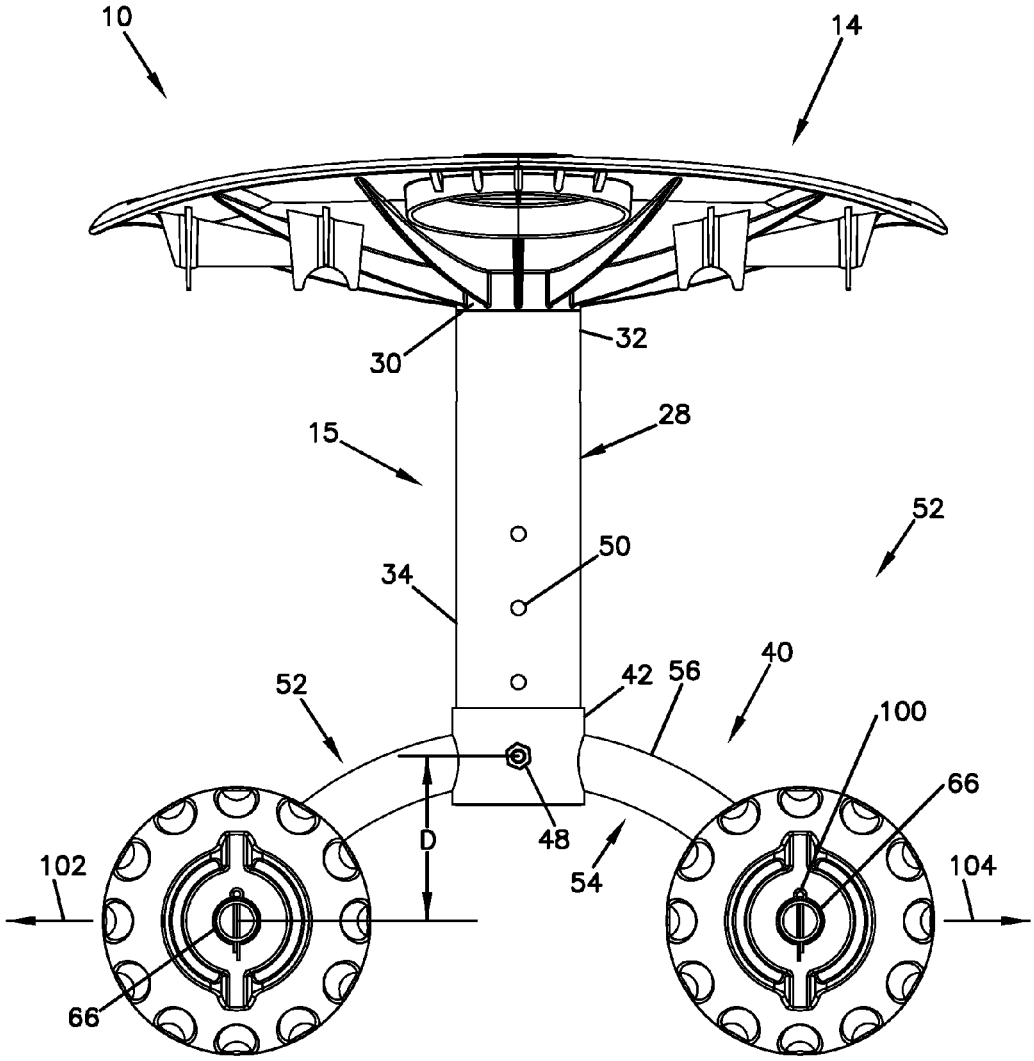
FIG. 4 is a left side view of the stool of FIG. 1.
Figure 5:
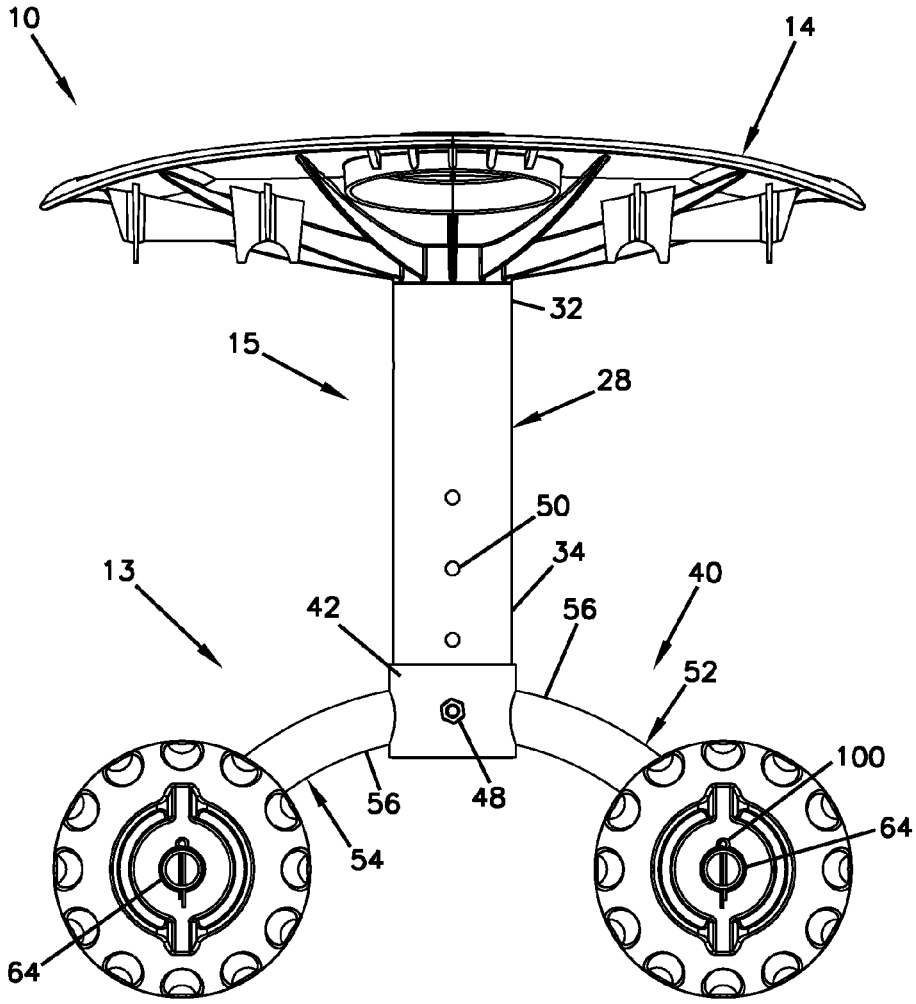
FIG. 5 is a right side view of the stool of FIG. 1.
Figure 6:
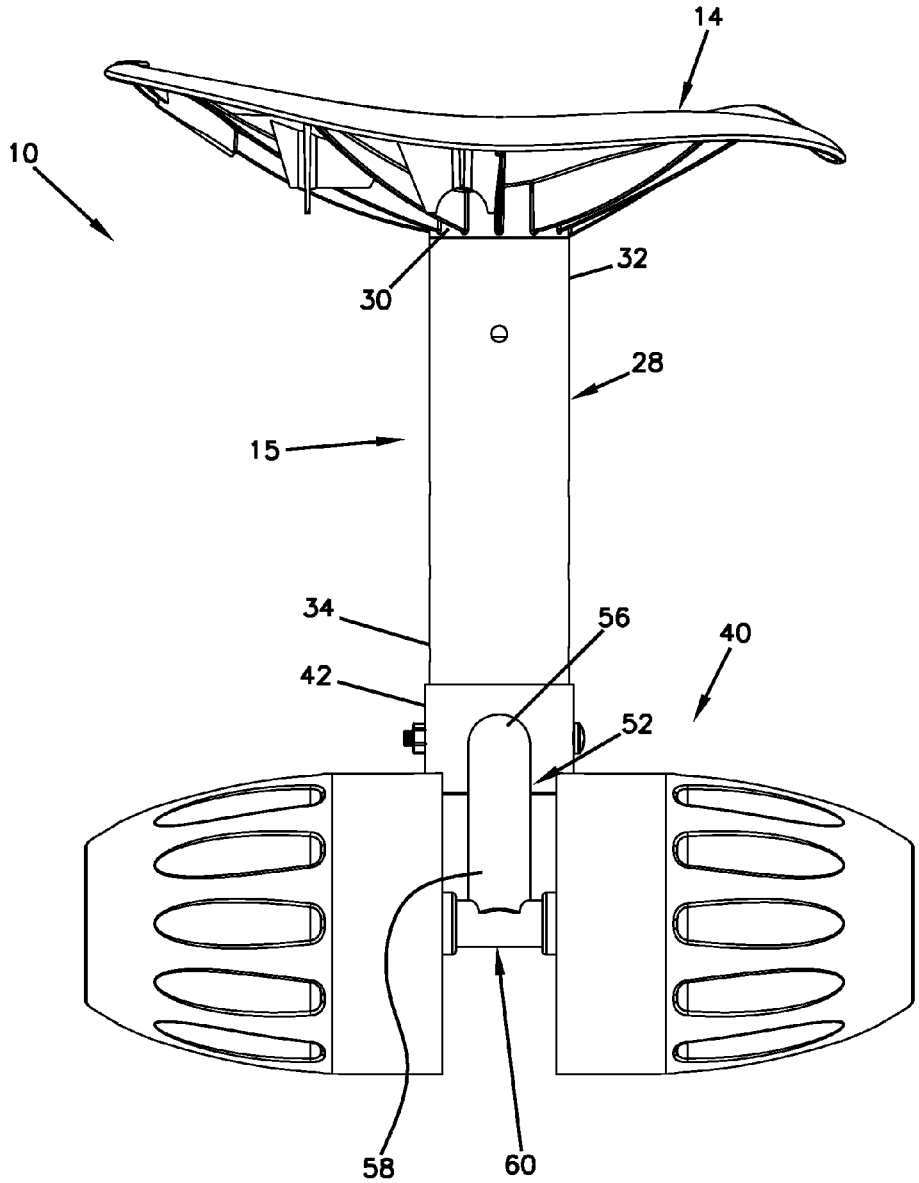
FIG. 6 is a front view of the stool of FIG. 1.
Figure 7:
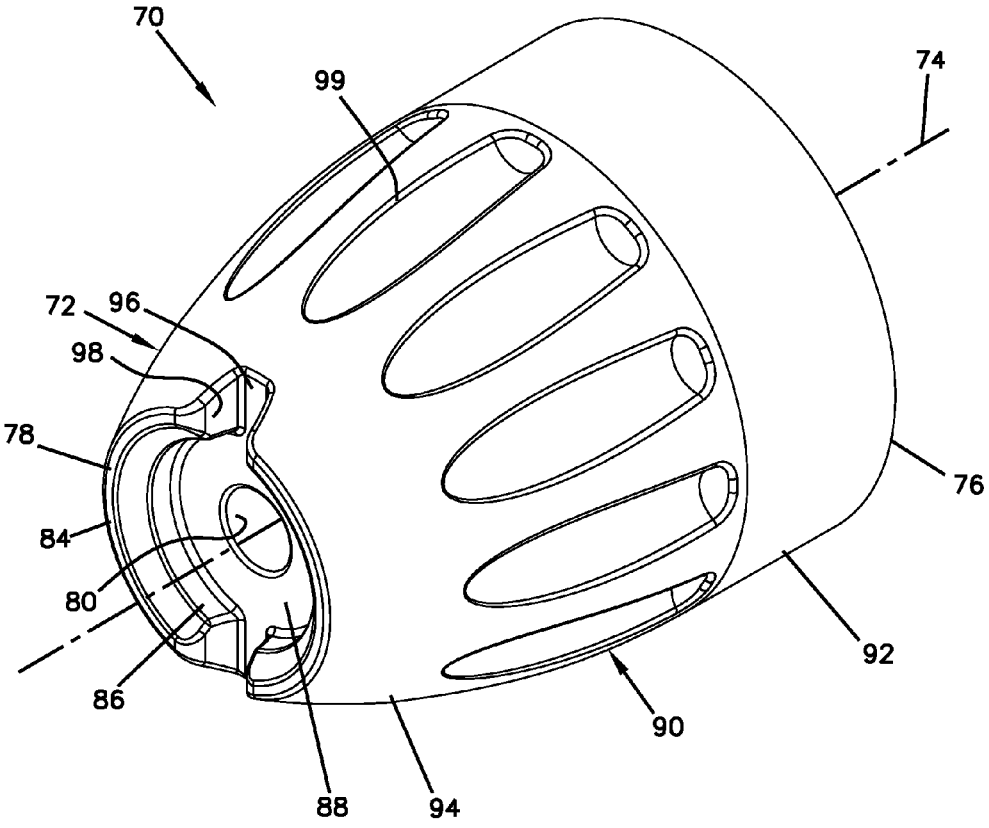
FIG. 7 is a perspective view of a wheel suitable for use with the stool of FIG. 1.
Figure 8:
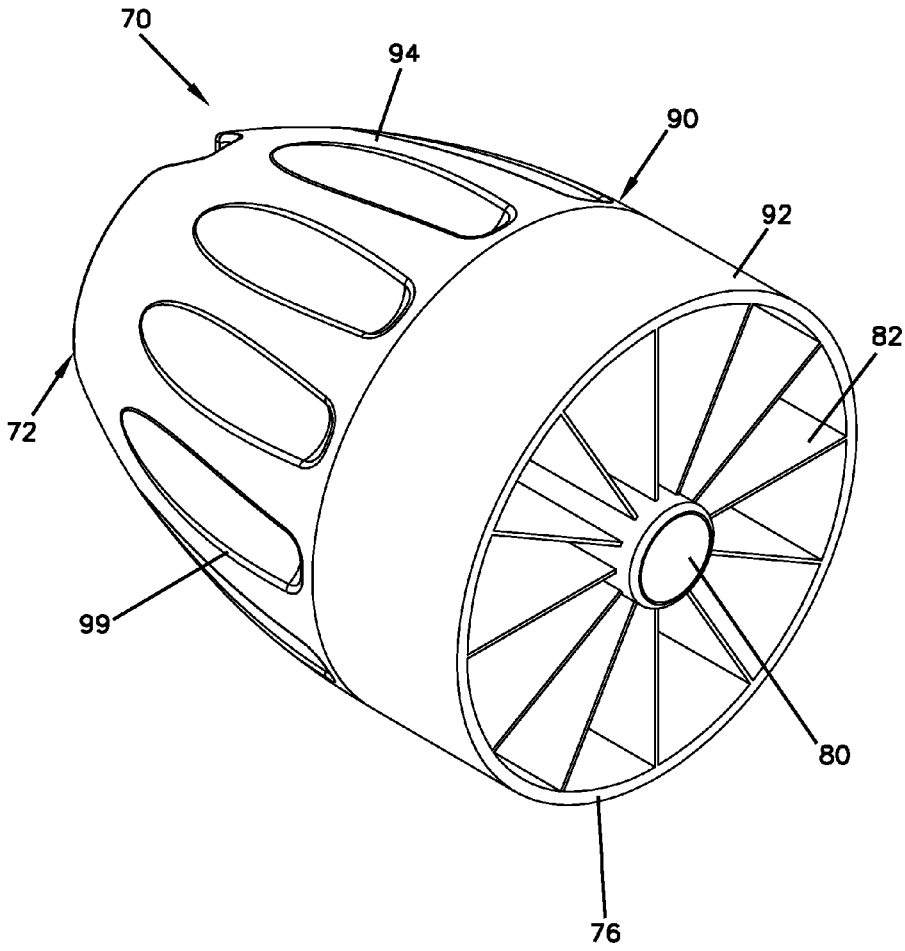
FIG. 8 is another perspective view of the wheel of FIG. 7.

As shown at FIG. 3, first regions of the wheels 70 are positioned directly beneath the seat 14 while second regions of the wheels 70 project outwardly from beneath the seat 14. The first regions preferably include the first portions 92 of the wheels 70 while the second regions at least partially include the second portions 94 of the wheels 70.

Figure 12:
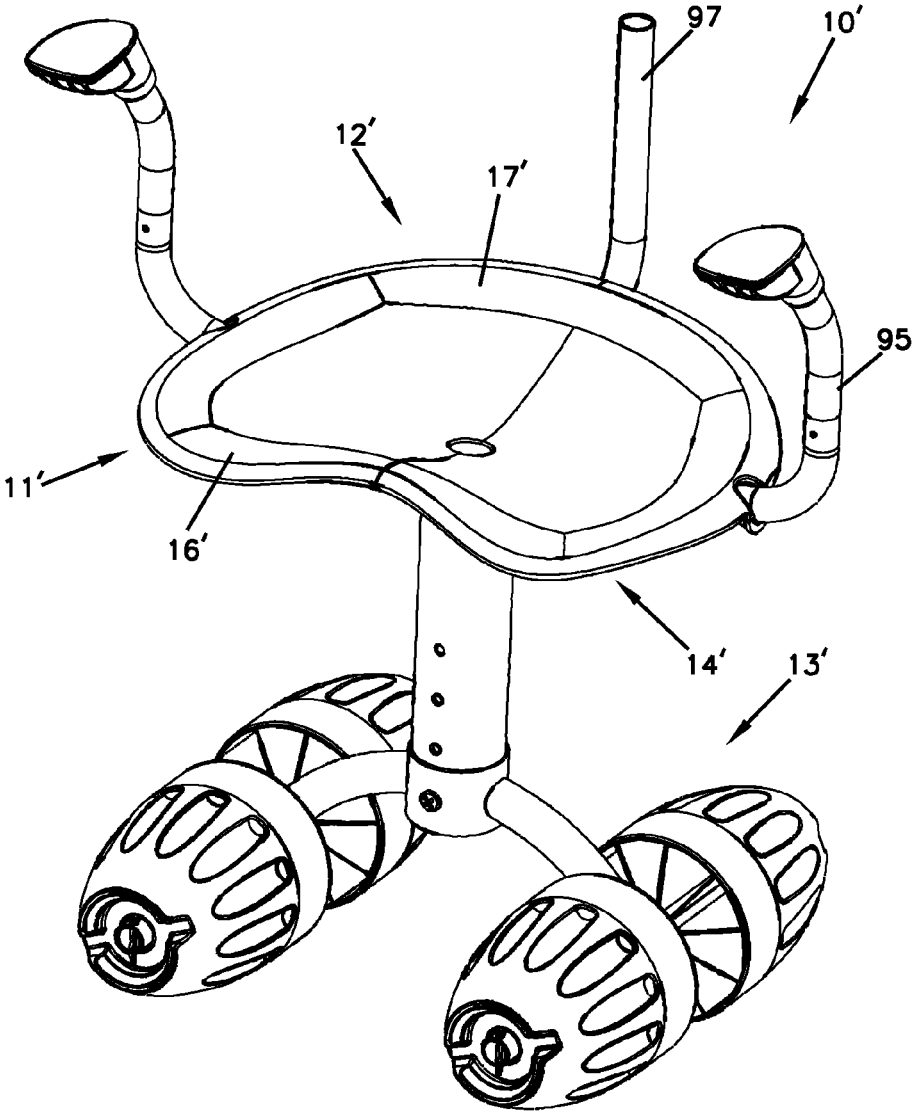
FIG. 12 is a perspective view of an alternate embodiment of a stool.

Referring now to FIG. 12, an alternate embodiment of a stool 10' is shown. The stool 10' includes a body 11' having a seat assembly 12' and a wheel assembly 13' connectedly engaged to the seat assembly 12'. In the depicted embodiment, the wheel assembly 13' is the same as the wheel assembly 13 that was previously described.

The seat assembly 12' includes a seat 14' having a front portion 16' and a back portion 17'. The seat assembly 12' further includes a plurality of arm rests 95. The arm rests 95 extend outwardly from the seat 14'. In the depicted embodiment, the arm rests 95 extend outwardly in a direction that is generally upward from the seat 12'.

The seat assembly 12' further includes a seat back 97. The seat back 97 extends outwardly from the seat 12'. In the depicted embodiment, the seat back 97 extends outwardly from the back portion 17' of the seat 12' in a direction that is generally upward from the seat 12'. The seat back 97 is adapted to receive a back rest and/or storage-type accessories.

Referring now to FIGS. 1, 2 and 4-6, a method of using the stool 10 will be described. With the wheels 70 of the stool 10 on the ground and a user sitting on the seat 14 of the stool 10, the user selectively propels the stool 10 in a first direction 102 (e.g., forward) and/or an opposite second direction 104 (e.g., backward). The first and second directions 102, 104 (shown as arrows in FIG. 4) are generally perpendicular to the first and second axles 60, 62 of the stool 10. The first portions 92 of the wheels 70*a*-70*d* engage the ground and assist in stabilizing the stool 10 when the stool is in an upright orientation. The portions 92 can be referred to as stabilization portions.

When the user propels the stool in the first direction 102, the user rotates the seat about the axis 38 so that the front portion 16 of the seat 14 faces in the first direction 102 (i.e., the travel position). As the stool 10 is propelled in the first direction 102, a majority of the weight of the stool 10 (e.g., the weight of the stool 10 includes the weight of the user) is distributed over the first portions 92 of the wheels 70*a*, 70*b*, 70*c*, 70*d*. In one embodiment, the second portions 94 of the wheels 70*a*, 70*b*, 70*c*, 70*d* are unloaded.

Figure 13:
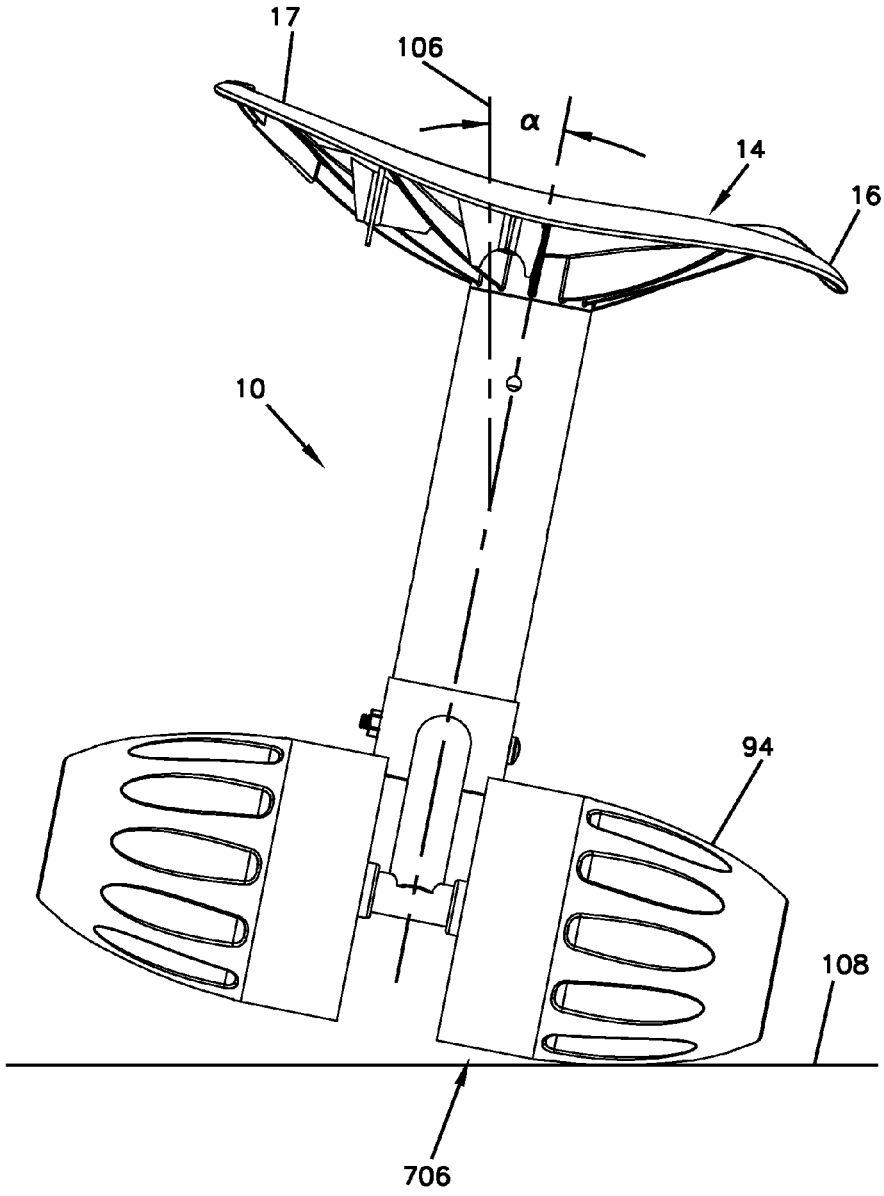
FIG. 13 is a front view of the stool of FIG. 1 shown tilted onto second portions of the wheels.

Referring now to FIG. 13, the user stops propelling the stool 10 in the first direction 102 (shown in FIG. 4) when the stool 10 reaches the desired location. The user rotates the seat 14 about 90 degrees about the axis 38 so that the seat 14 is in the working position. In the working position, the front portion 16 of the seat 14 faces in a direction that is about perpendicular to the first direction 102.

In order to reach vegetation at the ground level, the user leans forward on the seat 14 so that the stool 10 tilts at a tilt angle $\alpha$ away from an axis 106 that is generally perpendicular to a surface 108 on which the stool 10 is disposed. In the subject embodiment, the stool 10 tilts in a direction that is generally perpendicular to the first direction 102. The stool 10 tilts onto the second portions 94 of the wheels 70. With the stool 10 tilted onto the second portions 94 of the wheels 70, a majority of the weight of the stool 10 (e.g., the weight of the stool 10 includes the weight of the user) is distributed over the second portions 94 of the wheels 70*b*, 70*d* that are disposed beneath the front side 16 of the seat 14. In one embodiment, the tilt angle $\alpha$ of the stool 10 is in a range of about 5 degrees to about to about 30 degrees. In another embodiment, the tilt angle $\alpha$ is at least 15 degrees. As the tilt angle $\alpha$ increases, the curved nature of the second portions 94 of the wheels 70 causes the ground contact location to move progressively outwardly toward the second sides 78 of the wheels.

It will be appreciated that the configuration of the wheels allow the stool 10 to be rolled/propelled across the ground when the stool 10 is in the tilted orientation and when the stool is in the upright orientation. Thus, a gardener can move the stool during gardening while maintaining the stool in the tilted orientation. It will be appreciated that the wheels 70 are configured to retain the stool 10 in a stabilized upright position when the stool is not being tilted. The phrase "stabilized upright position" means that the stool can maintain the upright position by itself without supplemental support by a user.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A stool comprising:

a body having a seat selectively rotatable about an axis of the stool; and a wheel assembly engaged to the seat, the wheel assembly including a plurality of wheels, each of the wheels including an exterior surface having a first portion and a second portion, the second portion having a tapered surface;

wherein the body is adapted to tilt onto the second portions of the wheels.

2. The stool of claim 1, wherein the wheel assembly includes a frame having a first axle and a second axle.

3. The stool of claim 2, wherein a first wheel is engaged with a first end of the first axle, a second wheel is engaged with the second end of the first axle, a third wheel is engaged with a first end of the second axle and a fourth wheel is engaged with a second end of the second axle.

4. The stool of claim 1, wherein the first portion of each of the wheels is generally cylindrical.

5. The stool of claim 4, wherein the second portion of each of the wheels is generally frusto-elliptical.

6. The stool of claim 4, wherein the first portion of each of the wheels extends a first length along a central longitudinal axis of the wheel and the second portion extends a second length along the central longitudinal axis of the wheel, the first length being in a range of about 25% to about 75% of the second length.

7. The stool of claim 1, wherein the body tilts onto the second portion of the wheels at a tilt angle $\alpha$ in a range of about 5 degrees to about 30 degrees.

8. A stool comprising:

a body having:

a seat having a first surface and a second surface, the seat having a seat post that extends from the second surface; and a sleeve defining a bore that receives the seat post, wherein the seat is selectively rotatable about a vertical axis of the sleeve; and a wheel assembly engaged to the sleeve, wherein the height of the seat is adjustable relative to the wheel assembly, the wheel assembly including:

a frame having a first axle and a second axle;

a first plurality of wheels engaged to the first axle;

a second plurality of wheels engaged to the second axle;

wherein each of the wheels of the first and second plurality of wheels includes an exterior surface having a first portion and a second portion, the first portion being generally cylindrical, the second portion having a tapered surface;

wherein the body is adapted to tilt onto the second portions of the wheels.

9. The stool of claim 8, wherein the second portion of each of the wheels is generally frusto-elliptical.

10. The stool of claim 8, wherein the first portion of each of the wheels extends a first length along a central longitudinal axis of the wheel and the second portion extends a second length along the central longitudinal axis of the wheel, the first length being in a range of about 25% to about 75% of the second length.

11. The stool of claim 8, wherein the body tilts onto the second portion of the wheels at a tilt angle $\alpha$ in a range of about 5 degrees to about 30 degrees.

12. The stool of claim 8, wherein the second portion of the exterior surface of the wheels includes a plurality of passages that extend through the exterior surface.

13. The stool of claim 8, wherein the first and second pluralities of wheels are engaged to the first and second axles by fasteners.

14. The stool of claim 13, wherein the fasteners are cotter pins.

15. A method of using a stool, the method comprising:

propelling a stool in a first direction;

rotating a seat of the stool relative to wheels of the stool so that a front portion of the seat is generally perpendicular to the first direction;

tilting the stool onto tapered portions of exterior surfaces of wheels of the stool, wherein the stool is tilted in a direction that is generally perpendicular to the first direction.

16. The method of claim 15, wherein wheels include a cylindrical portion on which the stool is propelled when in an upright orientation.

17. The method of claim 16, wherein a length of the cylindrical portion is in the range of about 25% to about 75% of a length of the contoured portion.

18. The method of claim 15, wherein the stool can be tilted at a tilt angle $\alpha$ of at least 15 degrees, and wherein the stool can be propelled while tilted by causing the wheels to rotate while the tapered portions of the wheel engage the ground.

19. The method of claim 15, wherein the contoured portion is frusto-elliptical in shape.

20. The method of claim 15, wherein a length of the contoured portion of each wheel is in a range of about 25% to about 50% of a total length of the exterior surface of the wheel.

21. A stool comprising:

a plurality of wheels;

a seat;

a support structure that connects the seat to the wheels and that retains the seat at an elevated position relative to the wheels;

the wheels being configured to allow the stool to be pivoted between a stabilized upright position and a tilted position, the wheels including at least a first wheel having a tapered configuration, the first wheel having an inner end and an outer end, the first wheel being rotatable about an axis of rotation that extends through the first wheel from the inner end to the outer end, the first wheel defining a total length that extends along the axis of rotation from the first end to the second end, the total length being sufficient that the first wheel extends outwardly past a perimeter of the seat, the first wheel also including a tapered portion defining a taper length that extends along the axis of rotation, the taper length being at least 20 percent as long as the total length of the first wheel, the tapered portion being defined by an exterior surface of the first wheel that converges toward the axis of rotation as the exterior surface extends toward the outer end of the first wheel.

22. The stool of claim 21, wherein the exterior surface of the first wheel curves toward the axis of rotation as the exterior surface extends along the axis of rotation toward the outer end of the first wheel.

23. The stool of claim 21, wherein the tapered length of the first wheel is at least 30% as long as the total length of the first wheel.

24. The stool of claim 21, wherein the tapered length of the first wheel is at least 40% as long as the total length of the first wheel.

25. The stool of claim 21, wherein the tapered length of the first wheel is at least 50% as long as the total length of the first wheel.

26. The stool of claim 21, wherein the first wheel includes a stabilization portion for stabilizing the stool when the stool is in the upright position, wherein the stabilization portion is positioned adjacent the inner end of the first wheel, and wherein the exterior surface of the first wheel is either not tapered or is tapered substantially less than the tapered portion of the first wheel.

27. The stool of claim 21, wherein the tapered length of the first wheel is at least 2 inches.

28. The stool of claim 21, wherein the tapered length of the first wheel is at least 3 inches.

29. The stool of claim 21, wherein the first wheel defines a maximum outer diameter, and wherein the total length of the first wheel is greater than the maximum outer diameter.

30. The stool of claim 21, wherein the wheels include second, third and fourth wheels having a same tapered configuration as the first wheel, wherein the first and second wheels have co-axial axes of rotation, wherein the third and fourth wheels have co-axial axes of rotation, and wherein the axes of rotation of the first and second wheels and the axes of rotation of the third and fourth wheels are retained in a fixed parallel relationship relative to one another by the support structure.

* * * * *